US005193992A

United States Patent [19]

Terauchi

[11] Patent Number: 5,193,992

[45] Date of Patent: Mar. 16, 1993

[54] SCROLL TYPE FLUID DISPLACEMENT APPARATUS HAVING CONTROL OF THE LINE CONTACT URGING FORCE

[75] Inventor: Kiyoshi Terauchi, Isesaki, Japan

[73] Assignee: Sanden Corporation, Gunma, Japan

[21] Appl. No.: 702,336

[22] Filed: May 20, 1991

[30] Foreign Application Priority Data

May 18, 1990 [JP] Japan ..... 2-126908

[51] Int. Cl.[5] ..... F01C 1/04; F01C 17/06

[52] U.S. Cl. ..... 418/55.5; 418/57; 418/182

[58] Field of Search ..... 418/55.5, 57, 182

[56] References Cited

U.S. PATENT DOCUMENTS

| | | | |
|---|---|---|---|
| 1,906,141 | 4/1933 | Ekelof | 418/57 |
| 1,906,142 | 4/1933 | Ekelof | 418/57 |
| 3,874,827 | 4/1975 | Young | 418/57 |
| 3,924,977 | 12/1975 | McCullough | 418/57 |
| 4,460,321 | 7/1984 | Terauchi | 418/107 |
| 4,580,956 | 4/1986 | Takahashi et al. | 418/57 |
| 4,808,094 | 2/1989 | Sugimoto et al. | 418/55.5 |
| 4,824,346 | 4/1989 | Hiraga et al. | 448/57 |

FOREIGN PATENT DOCUMENTS

| | | | |
|---|---|---|---|
| 0192351 | 8/1986 | European Pat. Off. . | |
| 0236665 | 9/1987 | European Pat. Off. . | |
| 3911882 | 10/1989 | Fed. Rep. of Germany . | |
| 55-60684 | 5/1980 | Japan | 418/14 |
| 58-172402 | 10/1983 | Japan . | |
| 61-215481 | 9/1986 | Japan | 418/55.5 |
| 2-86976 | 3/1990 | Japan . | |
| 2-112684 | 4/1990 | Japan . | |
| 2-115588 | 4/1990 | Japan . | |

*Primary Examiner*—John J. Vrablik
*Attorney, Agent, or Firm*—Baker & Botts

[57] ABSTRACT

A scroll type fluid displacement apparatus is disclosed. A driving mechanism includes a drive shaft which is rotatably supported by the compressor housing. A crank pin eccentrically extends from an inner end of the drive shaft and is drivingly coupled to a bushing. The bushing has a central axis which is offset from the central axes of the drive shaft and the crank pin. The bushing transmits orbital motion to the orbiting scroll thereby developing line contacts between the spiral elements. A first line can be defined passing through the central axis of the drive shaft and the central axis of the bushing, a second line can be defined passing through the central axis of the bushing and perpendicular to the first line, and a third line can be defined between the central axis of the bushing and the central axis of the crank pin. As the bushing rotates about the crank pin, a reaction force due to the compressed gas is exerted on the central axis of the bushing. When abnormal reaction forces due to the compressed gas are exerted on the central axis of the bushing, a control mechanism reduces the angle between the second line and the third line. Thus, the sealing forces between the fluid respond to changes in compressor output and anti-wearing of the surfaces of the spiral elements can be assured.

15 Claims, 4 Drawing Sheets

SCROLL TYPE FLUID DISPLACEMENT APPARATUS HAVING CONTROL OF THE LINE CONTACT URGING FORCE

TECHNICAL FIELD

This invention relates to a scroll type fluid displacement apparatus, and more particularly, is directed to a scroll type compressor having a bushing in the orbiting scroll drive mechanism.

BACKGROUND OF THE INVENTION

Scroll type apparatuses have been well known in the prior art. For example, U.S. Pat. No. 4,824,346 discloses a device including two scrolls each having an end plate and a spiral wrap. The scrolls are maintained angularly offset so that both spiral elements interfit at a plurality of line contacts between their spiral curved surfaces to thereby seal off and define at least one pair of fluid pockets. The fluid pockets are defined by the line contacts between the two spiral elements which are interfitted together. One of the scrolls is an orbiting scroll and the other one is a fixed scroll.

The line contacts shift along the surface of the spiral elements by the orbital motion of the scroll to thereby move the fluid pockets to the center of the spiral elements and consequently compress the fluid in the pockets. It is desirable that the sealing force at the line contact be sufficiently maintained in a scroll type compressor. On the other hand, if the contact force between the spiral elements becomes too large in maintaining the sealing line contact, wear to the spiral elements increases. Accordingly, the contact force between the spiral elements must be suitably maintained.

With reference to FIGS. 6(*a*), 6(*b*), and 6(*c*) the operation of this type of compressor is described below.

Three scroll compressor components are shown including disk-shaped rotor 31, crank pin 45, and axial bushing 23. The relative orientations of the centers of disk-shaped rotor 31, crank pin 45, and axial bushing 23 are shown as Os, Od, and Oc, respectively. The distance between Os and Oc is the radius Ro of orbital motion. A line L2 can be defined passing through Oc and Os. Another line L1 can be defined passing through Oc and perpendicular to line L2. When crank pin 45 is fitted into eccentric hole 231 in bushing 23, center Od of crank pin 45 is placed, with respect to OS, on the opposite side of line L1 and also on the opposite side of line L2 in the counterclockwise rotational direction of arrow A of rotor 31. The relative positions of centers Os, Oc and Od is maintained in all rotative positions of rotor 31. Od, at this particular point of motion, is located in the upper left hand quadrant defined by lines L1 and L2.

When rotor 31 rotates, drive force Fd is exerted at Od to the left and reaction force Fr due to the compression of gas appears at Oc to the right, with both forces being parallel to line L1. As the arm Od-Oc swings outwardly by the creation of the moment generated by forces Fd and Fr, the spiral element of the orbiting scroll, which is rotatably disposed on bushing 23 through a needle bearing, is forced toward the spiral element of a fixed scroll. Consequently, the orbiting scroll orbits with the radius Ro around center Os of rotor 31. The rotation of the orbiting scroll is prevented by a rotation preventing mechanism, described in the above patent, whereby the orbiting scroll orbits but keeps its relative angular relationship. The fluid pockets are moved towards the center and thereby compressed by the orbital motion of the orbiting scroll.

When fluid is compressed by the orbital motion of the orbiting scroll, reaction force Fr, caused by the compression of the fluid, acts on the spiral element. This reaction force Fr acts in a direction tangential to the circle of orbiting motion. This reaction force, which is shown as Fr, in the final analysis, acts on center Oc of bushing 23. Since bushing 23 is rotatably supported by crank pin 45, bushing 23 is subject to a rotating moment generated by Fd and Fr with radius E2 (FIG. 6(*c*)) around center Od of crank pin 45. This moment is defined as $Fd(E2)(\sin\theta)$, where $\theta$ is the angle between the line Od-Oc and L1, and where $Fd=Fr$. The orbiting scroll, which is supported by bushing 23, is also subject to the rotating moment with radius E2 around center Od of crank pin 45 and, hence, the rotating moment is also transferred to the spiral element of the orbiting scroll. This moment urges the spiral element of the orbiting scroll against the spiral element of the fixed scroll with an urging or sealing force Fp. Fp acts through a moment arm $E3=E2\cos\theta$. Since the moments are equal, $FpE2\cos\theta=FdE2\sin\theta$. Thus, urging force Fp is expressed by the following formula:

$$Fp=Fd\tan\theta$$

Accordingly, urging force Fp can be controlled by properly choosing the value of the angle $\theta$. However, when abnormally high compression of the liquid refrigerant occurs, reaction force Fr increases greater than normal. Consequently, urging force Fp becomes undesirably large. When urging force Fp becomes too large, the contact force between both scroll elements also becomes too large. Thus, abnormal abrasion occurs between the wall surfaces of the scroll elements, thereby deforming and damaging the scroll elements. The problem of abnormal abrasion is further compounded by automotive air conditioning applications in which the scroll compressors are subject to a wide range of rotational speeds. That is, while one predetermined angle $\theta$ might be sufficient to accomplish the requisite urging force Fp, the urging force Fp becomes excessive when the compressor is operated under higher rotational speeds.

SUMMARY OF THE INVENTION

It is a primary object of this invention to provide an improved seal between the fluid pockets and reduce the wearing of the surfaces of the spiral elements in a scroll type compressor unit.

It is another object of this invention to provide a scroll type fluid displacement apparatus which is simple in construction and production and which achieves the above described object.

A scroll type fluid displacement apparatus according to the present invention includes a housing which has a fluid inlet port and a fluid outlet port. A fixed scroll is fixedly disposed in the housing and has a first end plate from which a first spiral element extends. An orbiting scroll has a second end plate from which a second spiral element extends. The first and second spiral elements interfit at an angular offset to make a plurality of line contacts to define at least one pair of sealed off fluid pockets. A driving mechanism includes a drive shaft which is rotatably supported by the housing. A crank pin eccentrically extends from an inner end of the drive shaft. A bushing includes a central axis which is offset from the central axes of the drive shaft and the crank pin. The bushing drivingly connects the crank pin to the orbiting scroll. A moment about the central axis of the crank pin is produced as the disk-shaped rotor rotates the crank pin. This in turn produces a reaction force from the compressed gas which is exerted on the central axis of the bushing. Consequently, the orbiting scroll is moved by the bushing in an orbital motion with line contact between the first and second spiral elements.

A control mechanism allows the bushing to shift its position in response to excessive reaction forces due to the compressed gas. Since the bushing can shift its position, the sealing forces between the fluid pockets can be suitably controlled despite the presence of excessive reaction forces tending to push the spiral elements together. The central mechanism is either a hinge between the drive shaft and the bushing or an elastic element disposed around the crank pin within the bushing bore.

More particularly, the invention may be characterized by a first line defined passing through the central axis of the drive shaft and the central axis of the bushing, a second line defined passing through the central axis of the bushing and perpendicular to the first line, and a third line defined between the central axis of the bushing and the central axis of the crank pin. The control mechanism reduces the angle between the second line and the third line when abnormal reaction forces due to the compressed gas are exerted on the central axis of the bushing.

Further objects, features and other aspects of this invention will be understood from the following detailed description of the preferred embodiments of this invention with reference to the annexed drawings.

DETAILED DESCRIPTION OF THE PREFERRED EMBODIMENT

Figure 1:
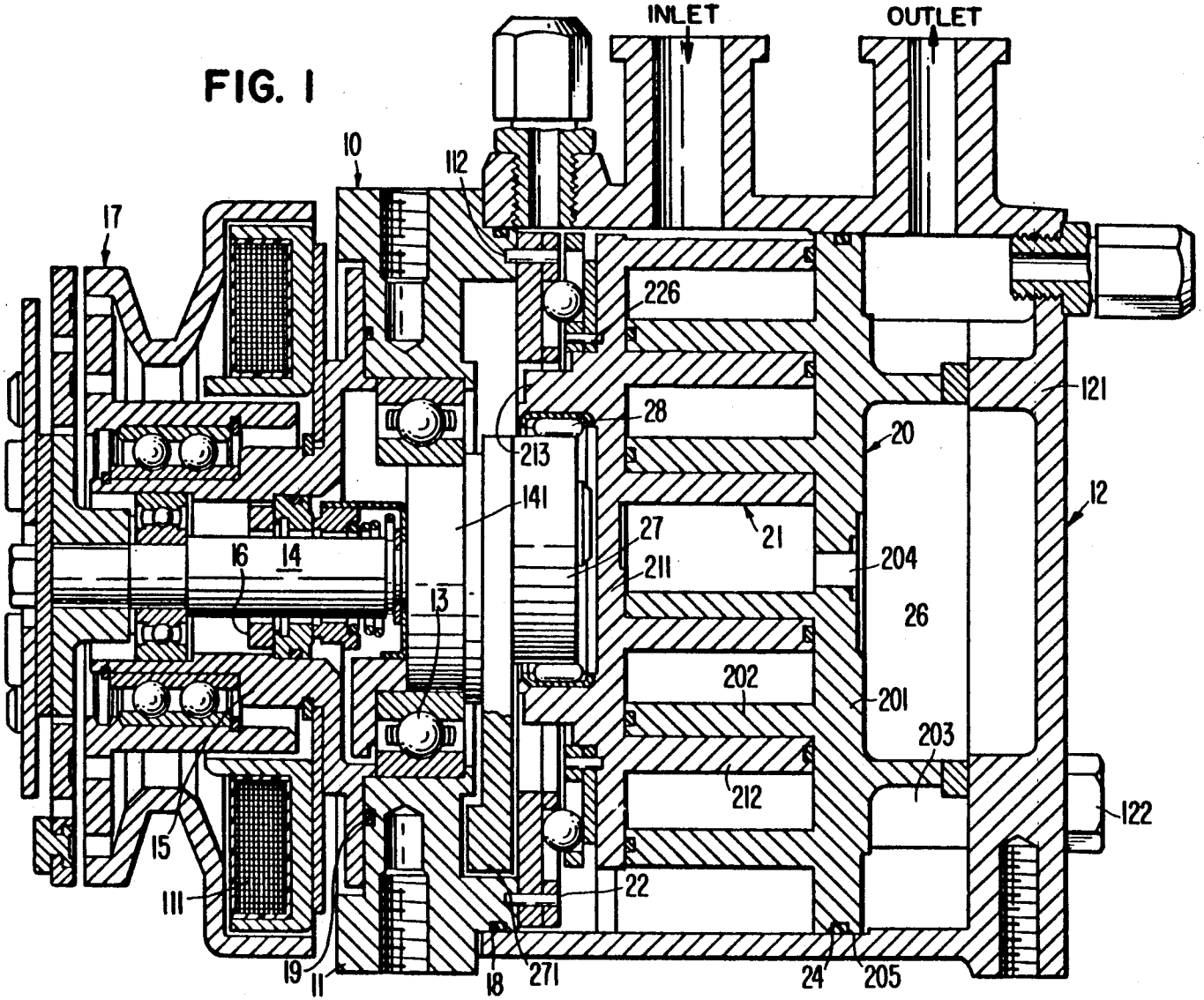
FIG. 1 is a cross-sectional view of a scroll type compressor in accordance with one embodiment of the present invention.

Referring to FIG. 1, a fluid displacement apparatus in accordance with one embodiment of a scroll type refrigerant compressor is shown. Cup-shaped casing 12 is fastened to an end surface of front end plate 11. Opening 111 is formed in the center of front end plate 11 for supporting drive shaft 14. The center of drive shaft 14 is thus aligned or concentric with the center line of housing 10. Annular projection 112, concentric with opening 111, is formed on the rear end surface of front end plate 11 and faces cup-shaped casing 12. Annular projection 112 contacts an inner wall of the opening of cup-shaped casing 12. Cup-shaped casing 12 is attached to the rear end surface of front end plate 11 by a fastening device, such as bolts and nuts (not shown), so that the opening of cup-shaped casing 12 is covered by front end plate 11. O-ring 18 is placed between the outer peripheral surface of annular projection 112 and the inner wall of the opening of cup-shaped casing 12 to seal the mating surfaces between front end plate 11 and cup-shaped casing 12.

Drive shaft 14 is formed with disk-shaped rotor 141 at its inner end portion. Disk-shaped rotor 141 is rotatably supported by front end plate 11 through bearing 13 located within opening 111. Front end plate 11 has annular sleeve 15 projecting from its front end surface. Sleeve 15 surrounds drive shaft 14 to define a shaft seal cavity. Shaft seal assembly 16 is assembled on drive shaft 14 within the shaft seal cavity. O-ring 19 is placed between the front end surface of front end plate 11 and the rear end surface of sleeve 15 to seal the mating surfaces between front end plate 11 and sleeve 15. As shown in FIG. 1, sleeve 15 is formed separately from front end plate 11 and is attached to the front end surface of front end plate 11 by screws (not shown). Alternatively, sleeve 15 may be formed integrally with front end plate 11.

Electromagnetic clutch 17 is supported on the outer surface of sleeve 15 and may be drivingly connected to the outer end portion of drive shaft 14.

An inner chamber of cup-shaped casing 12 is formed between the inner wall of cup-shaped casing 12 and the rear end surface of front end plate 11. Located within the inner chamber of cup-shaped casing 12 are fixed scroll 20, orbiting scroll 21, a driving mechanism for orbiting scroll 21, and a rotation preventing/thrust bearing device 22 for orbiting scroll 21.

Fixed scroll 20 includes circular end plate 201, wrap or spiral element (spiroidal wall) 202 affixed to and extending from one end surface of circular end plate 201, and a plurality of internal bosses 203. The end surface of each boss 203 is seated on an inner end surface of end plate portion 121 of cup-shaped casing 12 and fixed on end plate portion 121 by a plurality of bolts 122, one of which is shown in FIG. 1. Circular end plate 201 of fixed scroll 20 partitions the inner chamber of cup-shaped casing 12 into discharge chamber 26 and suction chamber 25. Sealing member 24 is placed within circumferential groove 205 in circular end plate 201 to form a seal between the inner wall of cup-shaped casing 12 and outer peripheral surface of circular end plate 201. Hole or discharge port 204 is formed through circular end plate 201 at a position near the center of the spiral elements to communicate between discharge chamber 26 and the center of the spiral elements.

Orbiting scroll 21, which is disposed in suction chamber 25, includes circular end plate 211 and wrap or spiral element (spiroidal wall) 212 affixed to and extending from one end surface of circular end plate 211. Both spiral elements 202 and 212 interfit at an angular offset of 180° and a predetermined radial offset to make a plurality of line contacts. The spiral elements define at least one pair of fluid pockets between their interfitting surfaces. Orbiting scroll 21 is connected to the driving mechanism and rotation preventing/thrust bearing device. Accordingly, drive shaft 14 rotates orbiting scroll 21 which produces an orbital motion having a circular radius Ro. Consequently, the fluid is compressed as it passes through the compressor.

Figure 2:
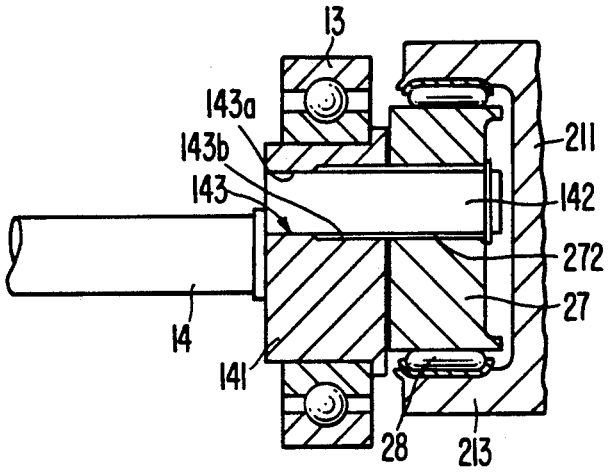
FIG. 2 is a main portion of a driving mechanism of a scroll type compressor as shown in FIG. 1.

Referring to FIG. 2 in conjunction with FIG. 1, the driving mechanism of orbiting scroll 21 will be described in greater detail. Drive shaft 14 is formed with disk-shaped rotor 141 at its inner end portion and is rotatably supported by front end plate 11 through bearing 13 located within opening 111 of front end plate 11. Circular end plate 211 of orbiting scroll 21 has tubular boss 213 axially projecting from the end surface opposite from which spiral element 212 extends. Axial bushing 27 fits into boss 213, and is rotatably supported therein by a bearing, such as needle bearing 28. Bushing 27 has balance weight 271 (FIG. 1) which is shaped as a portion of a disk and extends radially from bushing 27 along a front end surface thereof. Eccentric hole 272 is formed in bushing 27 at a position radially offset from the center of bushing 27.

Crank pin or drive pin 142 fits into axial bore 143 which is formed through disk-shaped rotor 141 and is radially offset from the center of drive shaft 14. Axial bore 143 comprises small diameter portion 143*a* and large diameter portion 143*b*. The diameter of crank pin 142 is equal to that of small diameter portion 143*a* and is less than that of large diameter portion 143*b*. One end of crank pin 143 is securedly connected with disk-shaped rotor 141 at small diameter portion 143*a* of axial bore 143 and extends through its large diameter portion 143*b* with a gap between the inner surface of large diameter portion 143*b* and the outer surface of crank pin 143. The other end of crank pin 142 is formed in a spherical shape at its outer surface and fits into the eccentrically disposed hole 272. The bushing is rotatable about the crank pin.

Bushing 27 is therefore driven in an orbital path by the revolution of crank pin 142 and can rotate within needle bearing 28. In the above construction, since crank pin 142 is disposed in axial bore 143 with a gap at its large diameter portion 143*b*, crank pin 142 can assume various angles with respect to the axis of axial bore 143. In addition, since crank pin 142 has a spherical-shaped outer surface in eccentric hole 272 on bushing 27, crank pin 142 can be inclined to the axis of bushing 27. Thus, crank pin 142 is hinged to allow movement of bushing 27.

Figure 3A:
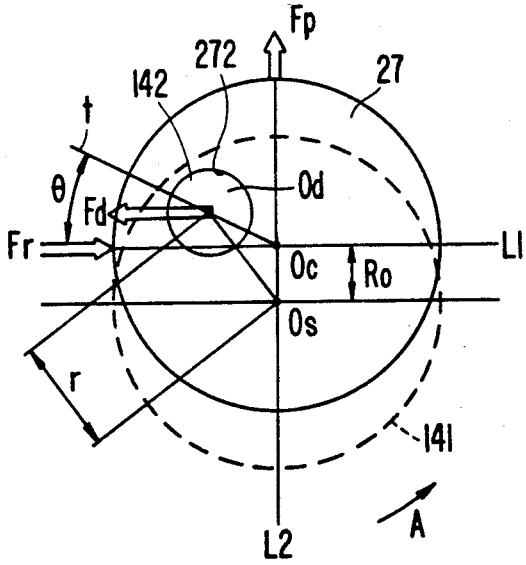
FIGS. 3(*a*) and 3(*b*) are diagrams of the motion of the bushing in the embodiment of FIG. 1.
Figure 3B:
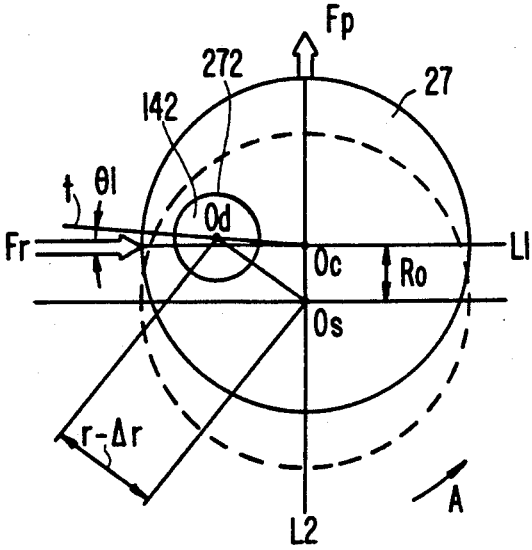

Referring to FIGS. 3(*a*) and 3(*b*), the operation of the driving mechanism as shown in FIG. 2 will be described below.

The relative orientations of the centers of disk-shaped rotor 141, crank pin 142, and bushing 27 are shown as Os, Od, and Oc, respectively. The distance between Os and Oc is the radius Ro of orbital motion. A line L2 can be defined passing through Oc and Os. Another line L1 can be defined passing through Oc and perpendicular to line L2. When crank pin 142 is fitted into eccentric hole 272 of bushing 27, center Od of crank pin 142 is placed, with respect to Os, on the opposite side of line L1 and also on the opposite side of line L2 in the counterclockwise rotational direction of arrow A of rotor 141. The relative position of centers Os, Oc and Od is maintained in all rotative positions of rotor 141 while the compressor is operated under normal air conditioning load. Od, at this particular point of motion, is located in the upper left hand quadrant defined by lines L1 and L2.

When orbiting spiral element 212 operates under normal air conditioning load, crank pin 142 orbits with radius r around center Os of rotor 141. On the other hand, when orbiting spiral element 212 operates under a high air conditioning load, a higher reaction force Fr from the compressed gas is exerted on center Oc of bushing 27. Consequently, crank pin 142 is inclined toward center Os of rotor 141, and center Od of crank pin 142 moves from the position as shown in FIG. 3(*a*) to the position as shown in FIG. 3(*b*). Since the radius Ro of orbital motion is not changed, crank pin 142 orbits with the radius r-Δr around center Os of rotor 141. Thus, angle $\theta$ between line t passing through Od and Oc and line L1 changes to angle $\theta 1$ which is less than angle $\theta$. Therefore, as angle $\theta$ becomes smaller, urging force Fp defined by $Fp=Fd\tan\theta$ also becomes smaller.

Figure 4:
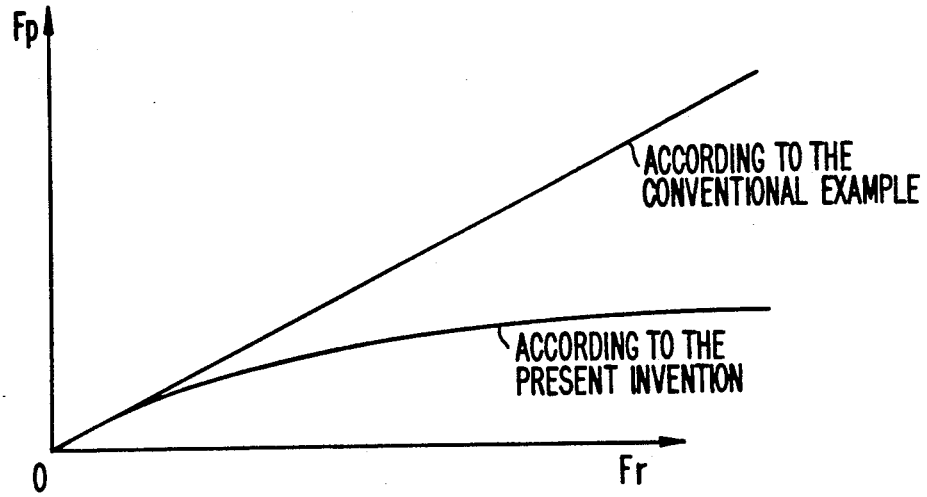
FIG. 4 is a graph illustrating the relationship between urging force Fp and driving force Fd.

Thus, as shown in FIG. 4, even though an abnormally large reaction force Fr acts on the scroll element, urging force Fp on orbiting spiral element 212 does not become too large.

Figure 5A:
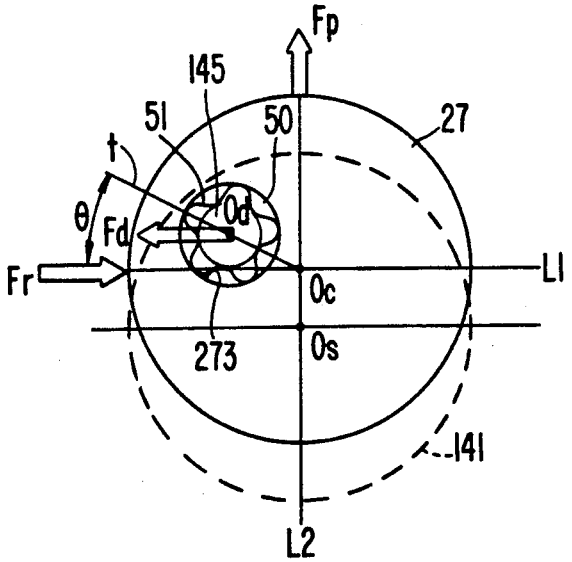
FIGS. 5(*a*) and 5(*b*) are diagrams of the motion of the bushing of a scroll type compressor in accordance with another embodiment of the present invention.
Figure 5B:
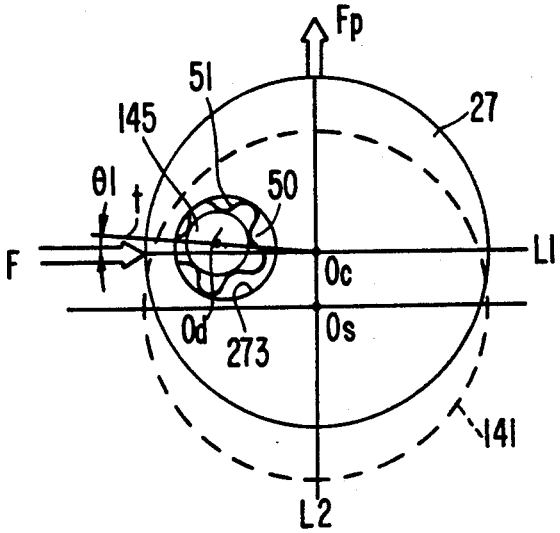
Figure 6A:
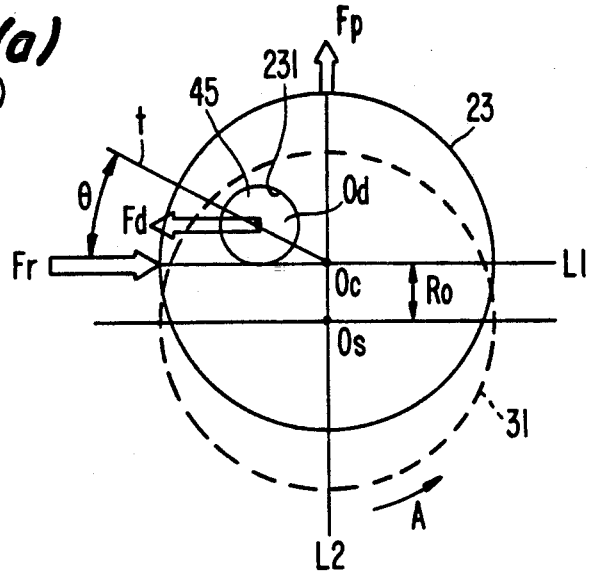
FIG. 6(a) (PRIOR ART)
FIGS. 6(*a*), 6(*b*), and 6(*c*) are diagrams of the motion of the bushing of a conventional scroll type compressor.
Figure 6B:
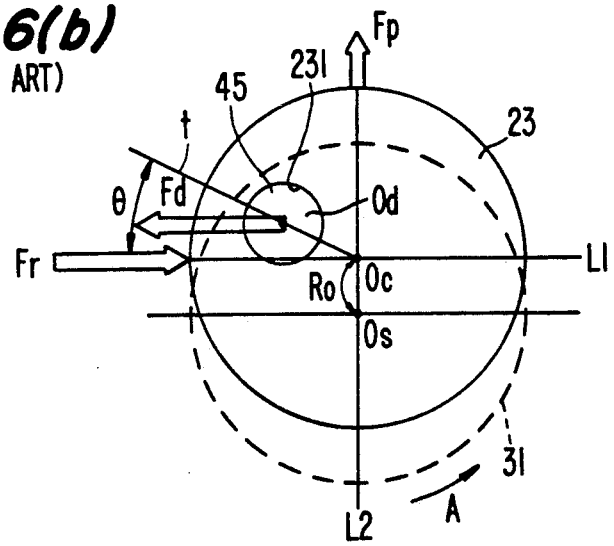
FIG. 6(b) (PRIOR ART)
Figure 6C:
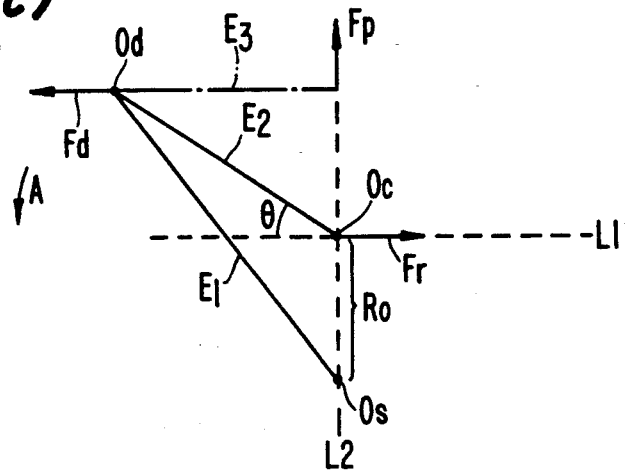
FIG. 6(c) (PRIOR ART)

Referring to FIGS. 5(*a*) and 5(*b*), the construction and operation of the driving mechanism in accordance with another embodiment of the present invention will be described below.

One end of crank pin 145 is fixedly connected on the end of disk-shaped rotor 141 such that crank pin 145 may not assume an angle with respect to the axis of the drive shaft. However, the diameter of crank pin 145 is less than that of eccentric hole 273 which is formed in bushing 27. Therefore, gap 50 is developed between the outer surface of crank pin 145 and the inner surface of eccentric hole 273. Star-shaped elastic member 51 is disposed in gap 50 and retains crank pin 145. The bushing is rotatable about the crank pin.

When orbiting spiral element 212 operates under the normal air conditioning load, center Od of crank pin 145 is positioned at the center of eccentric hole 273 as shown in FIG. 5(*a*). On the other hand, when orbiting spiral element 212 operates under a high air conditioning load, a higher reaction force Fr from the compressed gas is exerted on center Oc of bushing 27. Star-shaped elastic member 51 basically permits bushing 27 to shift its position in response to excessive reaction forces developed in the fluid pockets. Since crank pin 145 is fixedly connected with disk-shaped rotor 141, elastic member 51 is deformed as shown in FIG. 5(*b*), and the distance between centers Oc and Od lengthens. Thus, angle $\theta$ between line L1 and line t passing through Oc and Od changes to angle $\theta 1$ which is less than angle $\theta$. Therefore, as angle $\theta$ becomes smaller, urging force Fp defined by $Fp=Fd\tan\theta$ also becomes smaller.

As shown in the above embodiments, urging force Fp is therefore suitably maintained by reducing the angle between line L1 and line t which passes through Oc and Od. Other mechanisms accomplishing the same result can be conceived without departing from the spirit of the invention.

This invention has been described in detail in connection with the preferred embodiments, but those are examples only and the invention is not intended to be restricted thereto. It will be easily understood by those skilled in the art that variations and modifications can be easily made within the scope of this invention.

I claim:

1. In a scroll type fluid displacement apparatus including a housing having a fluid inlet port and a fluid outlet port, a fixed scroll fixedly disposed in said housing and having first end plate from which a first wrap extends, an orbiting scroll having a second end plate from which a second wrap extends, said first and second wraps interfitting at an angular offset to make a plurality of line contacts to define at least one pair of sealed off fluid pockets, a driving mechanism including a drive shaft rotatably supported by said housing and a crank pin eccentrically extending from an inner end of said drive shaft, a bushing including a central axis offset from the central axes of said drive shaft and said crank pin, said bushing drivingly connecting said crank pin to said orbiting scroll, said orbiting scroll being moved by said bushing in orbital motion, rotation preventing means for preventing the rotation of said orbiting scroll during its orbital motion, said bushing being rotatable about said crank pin, wherein a first line is defined as passing through the central axis of said drive shaft and the central axis of said bushing, a second line is defined as passing through the central axis of said bushing and perpendicular to the first line, a third line is defined as passing through the central axis of said bushing and the central axis of said crank pin, and a radius of orbital motion is defined as the distance between the central axis of said bushing and the central axis of said drive shaft, the improvement comprising:

a control mechanism to reduce the angle between the second line and the third line when an abnormal reaction force due to compressed gas in the sealed off fluid pockets is exerted on the central axis of said bushing, said control mechanism further maintaining the radius of orbital motion as a constant distance upon the occurrence of such abnormal reaction forces.

2. The scroll type fluid displacement apparatus of claim 1, further comprising a disk shaped rotor on the drive shaft, said control mechanism allowing relative rotation between said disk shaped rotor and said bushing when operating under abnormal pressures to maintain the radius of orbital motion.

3. A scroll type fluid displacement apparatus including a housing having a fluid inlet port and a fluid outlet port, a fixed scroll fixedly disposed in said housing and having a first end plate from which a first wrap extends, an orbiting scroll having a second end plate from which a second wrap extends, said first and second wraps interfitting at an angular offset to make a plurality of line contacts to define at least one pair of sealed off fluid pockets, said line contacts having an urging force therebetween, a driving mechanism including a drive shaft rotatably supported by said housing and a crank pin eccentrically extending from an inner end of said drive shaft, a bushing including a central axis offset from the central axes of said drive shaft and said crank pin, said bushing drivingly connecting said crank pin to said orbiting scroll, said orbiting scroll being moved by said bushing in orbital motion, rotation preventing means for preventing the rotation of said orbiting scroll during it orbital motion, said bushing being rotatable about said crank pin, wherein a first line is defined as passing through the central axis of said drive shaft and the central axis of said bushing, a second line is defined as passing through the central axis of said bushing and perpendicular to the first line, a third line is defined as passing through the central axis of said bushing and the central axis of said crank pin, and a radius of orbital motion is defined as the distance between the central axis of said bushing and the central axis of said drive shaft, the improvement comprising:

means for controlling the urging force between said line contacts;

wherein said control means maintains as a constant distance the radius of orbital motion regardless of the pressure in the sealed off fluid pockets; and wherein said means for controlling the urging force comprises means for permitting said bushing to shift position.

4. The scroll type fluid displacement apparatus of claim 3, said bushing shifts position in response to excessive pressure in said fluid pockets.

5. The scroll type fluid displacement apparatus of claim 3, said means for controlling the urging force comprising a control mechanism to reduce the angle between the second line and the third line when an abnormal reaction force due to compressed gas is exerted on the central axis of said bushing.

6. The scroll type fluid displacement apparatus of claim 3 wherein when said bushing shifts position, the angle between the second line and the third line changes.

7. The scroll type fluid displacement apparatus of claim 3, said crank pin being inclined with respect to the axis of said bushing when said bushing shifts position.

8. The scroll type fluid displacement apparatus of claim 3 wherein the axis of said crank pin is not inclined with respect to the axis of said bushing when said bushing shifts position.

9. The scroll type fluid displacement apparatus of claim 3, said means for permitting said bushing to shift position comprising a hinge on said inner end of said drive shaft.

10. The scroll type fluid displacement apparatus of claim 9 further comprising a disk-shaped rotor coaxially formed on said inner end of said drive shaft, said hinge for permitting said bushing to shift position comprising:

an axial bore eccentrically formed in said disk-shaped rotor, said axial bore having a small diameter portion and a large diameter portion, said crank pin having a first end and a spherically shaped second end, said first end disposed within and having the same diameter as said small diameter portion of said axial bore, said bushing having an eccentric bore, said spherically shaped second end disposed within said bore in said bushing, said large diameter portion of said axial bore and said spherically shaped second end of said crank pin cooperating to allow hinged movement of said bushing.

11. The scroll type fluid displacement apparatus of claim 3, said crank pin having a first end and a second end, said first end fixedly and eccentrically secured to said inner end of said drive shaft, said bushing having an eccentric bore, said second end disposed within said bore in said bushing, said crank pin having a first diameter, said bore in said bushing having a second diameter larger than said first diameter thereby forming a gap between said crank pin and said bore, said gap permitting said bushing to shift position in response to higher pressure in said fluid pockets.

12. The scroll type fluid displacement apparatus of claim 11 further comprising an elastic member disposed in said gap between said crank pin and said bore to bias said crank pin to the center of said bore.

13. In a scroll type fluid displacement apparatus including a housing having a fluid inlet port and a fluid outlet port, a fixed scroll fixedly disposed in said housing and having a first end plate from which a first wrap extends, an orbiting scroll having a second end plate from which a second wrap extends, said first and second wraps interfitting at an angular offset to make a plurality of line contacts to define at least one pair of sealed off fluid pockets, said line contacts having an urging force therebetween, a driving mechanism including a drive shaft rotatably supported by said housing and a crank pin eccentrically extending from an inner end of said drive shaft, a bushing including a central axis offset from the central axes of said drive shaft and said crank pin, said bushing drivingly connecting said crank pin to said orbiting scroll, said orbiting scroll being moved by said bushing in orbital motion, rotation preventing means for preventing the rotation of said orbiting scroll during its orbital motion, said bushing being rotatable about said crank pin, wherein a radius of orbital motion is defined as the distance between the central axis of said bushing and the central axis of said drive shaft, the improvement comprising:

means for limiting the urging force between said line contacts for avoiding excessive wear between the orbiting scroll and the fixed scroll while preventing the escape of fluid comprising means for permitting said bushing to shift position;

wherein when said scroll type fluid displacement apparatus operates under abnormal pressures, said control means prevents compressed fluid from escaping between said line contacts;

wherein said means for permitting said bushing to shift position comprises a hinge on said inner end of said drive shaft.

14. The scroll type fluid displacement apparatus of claim 13 further comprising a disk-shaped rotor coaxially formed on said inner end of said drive shaft, said hinge for permitting said bushing to shift position comprising:

an axial bore eccentrically formed in said disk-shaped rotor, said axial bore having a small diameter portion and a large diameter portion, said crank pin having a first end and a spherically shaped second end, said first end disposed within and having the same diameter as said small diameter portion of said axial bore, said bushing having an eccentric bore. said spherically shaped second end disposed within said bore in said bushing, said large diameter portion of said axial bore and said spherically shaped second end of said crank pin cooperating to allow hinged movement of said bushing.

15. In a scroll type fluid displacement apparatus including a housing having a fluid inlet port and a fluid outlet port, a fixed scroll fixedly disposed in said housing and having a first end plate from which a first wrap extends, an orbiting scroll having a second end plate from which a second wrap extends, said first and second wraps interfitting at an angular offset to make a plurality of line contacts to define at least one pair of sealed off fluid pockets, said line contacts having an urging force therebetween, a driving mechanism including a drive shaft rotatably supported by said housing and a crank pin eccentrically extending from an inner end of said drive shaft, a bushing including a central axis offset from the central axes of said drive shaft and said crank pin, said bushing drivingly connecting said crank pin to said orbiting scroll, said orbiting scroll being moved by said bushing in orbital motion, rotation preventing means for preventing the rotation of said orbiting scroll during its orbital motion, said bushing being rotatable about said crank pin, wherein a radius of orbital motion is defined as the distance between the central axis of said bushing and the central axis of said drive shaft, the improvement comprising:

means for limiting the urging force between said line contacts for avoiding excessive wear between the orbiting scroll and the fixed scroll while preventing the escape of fluid comprising means for permitting said bushing to shift position;

wherein when said scroll type fluid displacement apparatus operates under abnormal pressures, said control means prevents compressed fluid from escaping between said line contacts;

wherein said crank pin comprises a first and a second end, said first end fixedly and eccentrically secured to said inner end of said drive shaft, said bushing having an eccentric bore, said second end disposed within said bore in said bushing, said crank pin having a first diameter, said bore in said bushing having a second diameter larger than said first diameter thereby forming a gap between said crank pin and said bore, said gap permitting said bushing to shift position in response to higher pressure in said fluid pockets; and further comprising an elastic member disposed in said gap between said crank pin and said bore to bias crank pin to the center of said bore.

* * * * *